United States Patent [19]

Moe et al.

[11] 4,203,247

[45] May 20, 1980

[54] TOY VEHICLE LAUNCHER AND TOY VEHICLE FOR USE THEREWITH

[75] Inventors: Walter Moe, Los Angeles; Lawrence A. Bernstein, Malibu; David Heller, Los Angeles, all of Calif.

[73] Assignee: Diker-Moe Associates, West Los Angeles, Calif.

[21] Appl. No.: 873,433

[22] Filed: Jan. 30, 1978

[51] Int. Cl.[2] ..... A63H 33/00

[52] U.S. Cl. ..... 46/1 K; 46/202

[58] Field of Search ..... 46/1 K, 43, 202; 273/86 B

[56] References Cited

U.S. PATENT DOCUMENTS

| | | | |
|---|---|---|---|
| 763,036 | 6/1904 | Austin et al. | 46/202 |
| 1,186,966 | 6/1916 | Bramkamp | 46/202 |

FOREIGN PATENT DOCUMENTS

| | | | |
|---|---|---|---|
| 1905262 | 8/1970 | Fed. Rep. of Germany | 46/1 K |

*Primary Examiner*—Louis G. Mancene
*Assistant Examiner*—Paul J. Hirsch

[57] ABSTRACT

A toy vehicle launcher and a toy vehicle for use therewith is disclosed. The toy vehicle launcher includes first and second spaced, generally parallel sidewalls each having an inner surface and an outer surface. A first and a second spiral retainer member are attached to the inner surfaces of the first and second sidewalls respectively. The second spiral member is opposed to the first spiral retainer member, and is generally parallel thereto throughout its length. Each of the spiral retainer members has a first end near the center of the sidewalls of the toy vehicle launcher and a second end near the periphery of the toy vehicle launcher. One of the sidewalls has an aperture therein near its center through which the toy vehicle to be launched can be placed into contact with the first and second spiral retainer members near their first ends. The toy vehicle launcher also includes a second aperture adjacent the second ends of the spiral retainer members. A drive member drives the toy vehicle along the first and second spiral retainer members from the first ends towards the second ends thereof. The toy vehicle is driven along the spiral retainer members and is ejected from the vehicle launcher through the second aperture at the second ends of the spiral retainer members.

4 Claims, 4 Drawing Figures

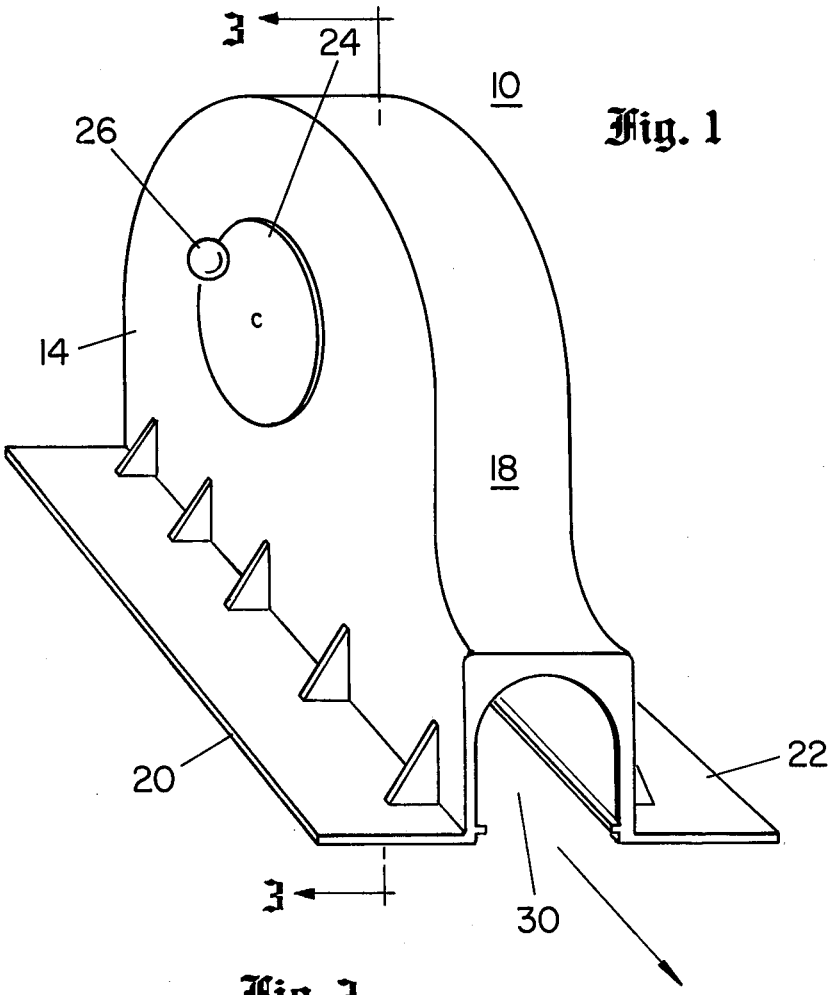
Fig. 1
Fig. 2
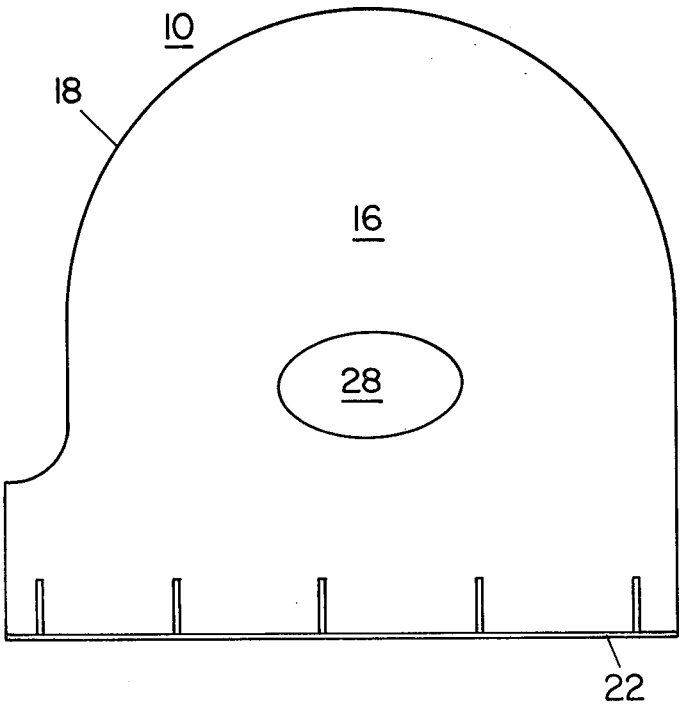
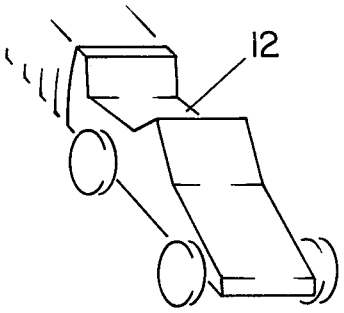

TOY VEHICLE LAUNCHER AND TOY VEHICLE FOR USE THEREWITH

The present invention relates to toys, and more particularly to a new toy vehicle launcher and toy vehicle for use therewith.

It is the object of the present invention to provide an improved toy vehicle launcher and toy vehicle for use therewith.

It is another object of the present invention to provide such an improved toy vehicle launcher which launches the toy vehicle onto a floor or the like at relatively high rates of speed.

It is yet another object of the present invention to provide an improved toy vehicle launcher and toy vehicle for use therewith which is simple to operate and safe to use so that it can be easily operated by children.

Briefly stated, and in accordance with the presently preferred embodiment of the invention, a toy vehicle launcher is provided which includes a toy vehicle for use therewith. The toy vehicle launcher includes first and second spaces, generally parallel sidewalls each having an inner surface and an outer surface. A first and a second spiral retainer member is provided, which are attached to the inner surfaces of the first and second sidewalls, respectively. The second spiral retainer member is opposed to the first spiral retainer member, and is generally parallel thereto throughout its length. Each of the spiral retainer members comprises a predetermined number of turns, and has a first end near the center of the sidewalls of the toy vehicle launcher and a second end near the periphery of the toy vehicle launcher. One of the sidewalls has an aperture therein near its center through which the toy vehicle to be launched can be placed into contact with the first and second spiral retainer members near their first ends thereof. The toy vehicle launcher also includes a second aperture adjacent the second ends of the spiral retainer members. Drive means are provided for driving the toy vehicle along the first and second spiral retainer members from the first ends towards the second ends thereof. The toy vehicle includes means to engage the two spiral retainer members. When the toy vehicle is driven along the spiral retainer members and when it reaches their second ends, it is ejected from the vehicle launcher through the second aperture at a relatively high rate of speed.

For a complete understanding of the inventon together with an appreciation of its other objects and advantages, please refer to the following detailed description of the attached drawings, in which:

FIG. 1 shows a perspective view of a toy vehicle launcher and toy vehicle in accordance with the present invention;

FIG. 2 shows a plan view of the back side of the toy vehicle launcher of FIG. 1;

Figure 3:
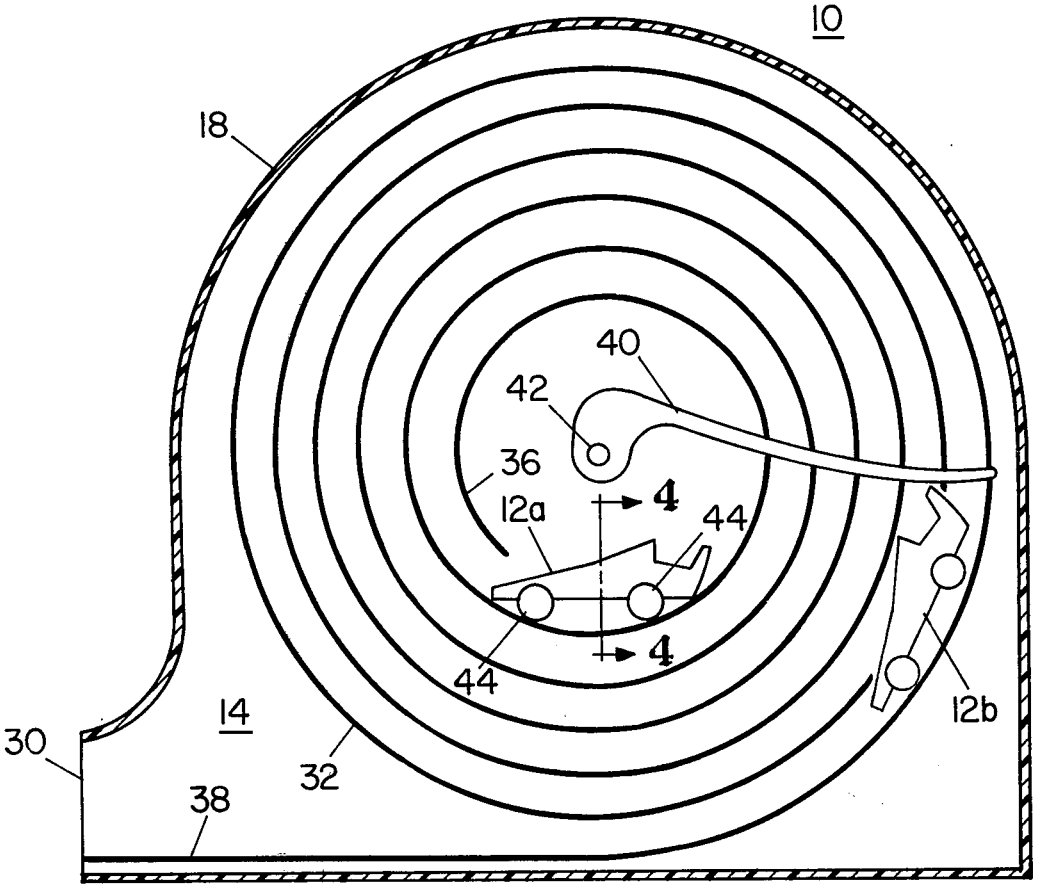
Figure 4:
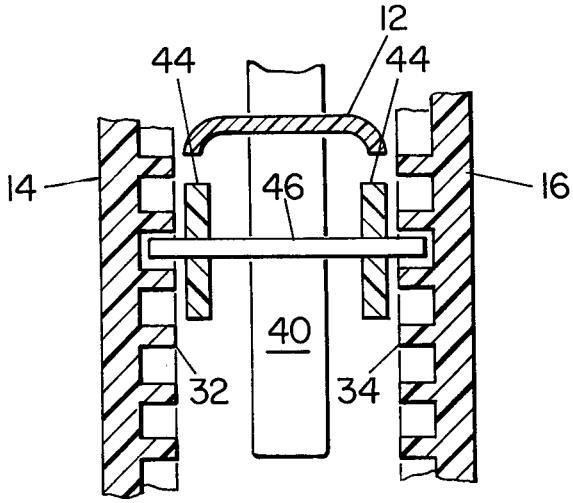

FIG. 3 shows a cross-sectional view of the toy vehicle launcher taken along the lines 3—3 of FIG. 1 and illustrates how the toy vehicle engages the toy vehicle launcher and is driven by the toy vehicle launcher; and FIG. 4 is a cross-sectional view taken along the lines 4—4 of FIG. 3 and shows a detailed view of a second embodiment of the present invention, illustrating a second manner in which the toy vehicle may engage the toy vehicle launcher while being driven by the toy vehicle launcher.

FIG. 1 shows a perspective view of the toy vehicle launcher 10 of the present invention. In FIG. 1, the toy vehicle 12 has just been launched by the toy vehicle launcher 10. FIG. 2 is a plan view of the side of the toy vehicle launcher 10 away from the viewer in FIG. 1, or of the back side of the toy vehicle launcher 10. The following description is of FIGS. 1 and 2 simultaneously, with the same reference numeral being used to identify the same part or component of the two views.

The toy vehicle launcher 10 includes a first sidewall member 14 on one side thereof and a second sidewall member 16 on the other side thereof. The two sidewall members 14 and 16 are flat members which are spaced from each other in a generally parallel manner. As is described in more detail in the description of the other figures, each of the sidewall members 14 and 16 includes an inner surface and an outer surface.

The toy vehicle launcher 10 also includes a generally curved surface 18 which joins the two sidewall members 14 and 16, and a pair of supporting flange surfaces 20 and 22, attached to the bottom of the sidewall members 14 and 16 respectively, to provide a more stable base to support the toy vehicle launcher in a generally vertical position on a floor or the like, as shown in FIG. 1.

The toy vehicle launcher 10 also includes a disc shaped member 24 having a handle 26 rotatably attached thereto. As is described in more detail in connection with FIG. 3 below, a child or other user of the toy rotates the disc member 24 by turning the handle 26 to operate the drive means to launch the toy vehicle 12 from the toy vehicle launcher 10.

The toy vehicle launcher 10 further includes a first aperture 28 in the second sidewall 16, located near the center of the second side member 16, and a second aperture 30 located along the periphery of the toy vehicle launcher and beneath the curved surface 18. As is described in more detail below, in operation, the toy vehicle 12 is placed through the first aperture 28 into the toy vehicle launcher 10, and is ejected at a high rate of speed from the toy vehicle launcher 10 through the second aperture 30.

FIG. 3 shows a cross-sectional view taken along the lines 3-3 of FIG. 1, and illustrates how the toy vehicle launcher 10 launches the toy vehicle 12.

As is shown in FIG. 3, a first spiral retainer member 32 is attached to the inner surface of the first sidewall member 14. This spiral retainer member 32 includes a predetermined number of turns (approximately six are shown in FIG. 3), and has a first end 36 near the center of the sidewall member 14 and a second end 38 which extends to the second aperture 30 along the periphery of the toy vehicle launcher 10. A second spiral retainer member 34 (not shown in FIG. 3, see FIG. 4), is provided which is attached to the inner surface of the second sidewall member 16. This second spiral retainer member 34 is opposed to and is parallel to the first spiral retainer member 32 throughout its length. Thus, it too has a first end near the center of the sidewall member 16 and a second end which terminates at the periphery of the toy vehicle launcher 10 adjacent the second aperture 30.

The toy vehicle launcher 10 is completed by a radial whip or drive member 40 which is attached to an axle 42. The ends of the axle 42 are rotatably supported by the sidewall members 14 and 16, and the end of the axle 42 adjacent the sidewall member 14 is secured to the disc member 24 (see FIG. 1). Thus, when the disc member 24 is rotated by turning the handle 26, the whip member 40 is rotated within the toy vehicle launcher 10. As will be apparent from the description of the operation of the device below, the disc member 24, the handle 26, the whip member 40 and the axle 42 comprise a drive means for driving the toy vehicle 12 along the first and second spiral retainer members 32 and 34 to cause the toy vehicle 12 to be ejected from the toy vehicle launcher 10 through the second aperture 30.

In operation, a child or other user of the toy places a toy vehicle through the first aperture 28 in the toy vehicle launcher 10 so that the wheels 44 of the toy vehicle 12 engage the first and second spiral retainer members 32 and 34 near the first ends thereof. The toy vehicle 12*a* of FIG. 3 is shown in this position. The user then rotates the handle 26 until the whip member 40 engages the rear end of the toy vehicle 12. Continued rotation of the handle 26 causes the whip member 40 to drive the toy vehicle 12 around the spiral retainer members 32 and 34. Assuming that the handle 26 is being turned at a constant angular velocity, the toy vehicle is driven at this same constant angular velocity along the spiral retainer members 32 and 34. But with each succeeding turn of the handle, the toy vehicle 12 is being moved radially further away from the center of the spiral retainer members 32 and 34. Thus, since the angular velocity is essentially constant, the linear velocity of the toy vehicle is continuously increasing, and the toy vehicle accellerates to a faster and faster velocity. In FIG. 3, the toy vehicle 12*b* illustrates the position of such a toy vehicle as it nears the end of the portion of the spiral retaining members at which the whip member 40 can engage the rear end of the toy vehicle to drive it. At this point, the toy vehicle has reached its maximum speed, and continues down the spiral retainer members towards the second ends 38 thereof. It is then ejected through the second aperture 30 from the toy vehicle launcher 10 at a high rate of speed. (Of course, normally only one vehicle will be in the toy vehicle launcher 10 at a given time. The toy vehicles 12*a* and 12*b* are both shown in FIG. 3 merely to illustrate the manner of operation of the device.)

FIG. 4 shows a sectional view taken along the lines 4—4 of FIG. 3 and schematically illustrates a second embodiment of the invention. As was noted above, in the embodiment of FIG. 3, the wheels 44 of the toy vehicle 12 rests directly on the two spiral retainer members 32 and 34. In the embodiment of FIG. 4, the wheels 44 of the toy vehicle 12 do not rest upon or directly engage the spiral retainer members 32 and 34. Instead, the toy vehicle 12 includes an axle 46 upon which the wheels 44 are mounted. The axle 46 extends through both wheels 44 and it is the two ends of the axle 46 which engage the spiral retainer members 32 and 34. Obviously, this embodiment could be further modified to provide hubs on the wheels 44 which engage the spiral retainer members 32 and 34 in a similar manner, and having the ends of the axle 46 terminating in these hubs.

While the invention is thus disclosed and several embodiments described in detail, it is not intended that the invention be limited to these shown embodiments. Instead, many modifications will occur to those skilled in the art which lie within the spirit and scope of the invention. It is intended that the invention be limited only by the appended claims.

What is claimed is:

1. A toy comprising, in combination, a toy vehicle and a toy vehicle launcher, the toy vehicle launcher including:

first and second spaced, generally parallel sidewalls each having an inner surface and an outer surface, a first spiral retainer member attached to the inner surface of the sidewall, a second spiral retainer member attached to the inner surface of the second sidewall, the second spiral retainer member being opposed to the first spiral retainer member, each of the spiral retainer members comprising a predetermined number of turns and having a first end near the center of the sidewalls of the toy vehicle launcher and a second end near the periphery of the toy vehicle launcher, at least one of the sidewalls of the toy vehicle launcher having an aperture therein near its center through which the toy vehicle can be placed into contact with the first and second spiral retainer members near the first ends thereof, a second aperture in the toy launch vehicle adjacent the second ends of the first and second spiral retainer members, and drive means for driving the toy vehicle along the first and second spiral retainer members from the first ends thereof towards the second ends thereof, the toy vehicle including means to engage the spiral retainer members of the toy vehicle launcher.

2. The invention of claim 1 in which the drive means comprises an axle rotatably secured to the first and second sidewalls of the toy vehicle launcher, a drive member extending radially from the axle, and handle means extending from the outer surface of one of the sidewalls for rotating the axle.

3. A toy vehicle launcher, comprising:

first and second spaced, genrally parallel sidewalls each having an inner surface and an outer surface, a first spiral retainer member attached to the inner surface of the first sidewall, a second spiral retainer member attached to the inner surface of the second sidewall, the second spiral retainer member being opposed to the first spiral retainer member, each of the spiral retainer members comprising a predetermined number of turns and having a first end near the center of the sidewalls of the toy vehicle launcher and a second end near the periphery of the toy vehicle launcher, at least one of the sidewalls of the toy vehicle launcher having an aperture therein near its center through which a toy vehicle can be placed into contact with the first and second spiral retainer members near the first ends thereof, a second aperture in the toy launch vehicle adjacent the second ends of the first and second spiral retainer members, and drive means for driving a toy vehicle along the first and second spiral retainer members from the first ends thereof towards the second ends thereof.

4. The invention of claim 3 in which the drive means comprises an axle rotatably secured to the first and second sidewalls of the toy vehicle launcher, a drive member extending radially from the axle, and handle means extending from the outer surface of one of the sidewalls for rotating the axle.

* * * * *